US009505020B2

(12) United States Patent
Rademacher

(10) Patent No.: US 9,505,020 B2
(45) Date of Patent: Nov. 29, 2016

(54) APPLICATOR FOR APPLYING A SEALING COMPOUND TO AN EDGE-RAISED SEAM AND ASSOCIATED OPERATING METHOD

(75) Inventor: Lothar Rademacher, Bietigheim-Bissingen (DE)

(73) Assignee: Duerr Systems GmbH, Bietigheim-Bissingen (DE)

( * ) Notice: Subject to any disclaimer, the term of this patent is extended or adjusted under 35 U.S.C. 154(b) by 978 days.

(21) Appl. No.: 12/997,400

(22) PCT Filed: Jun. 3, 2009

(86) PCT No.: PCT/EP2009/003974

§ 371 (c)(1),
(2), (4) Date: Dec. 10, 2010

(87) PCT Pub. No.: WO2009/149854

PCT Pub. Date: Dec. 17, 2009

(65) Prior Publication Data

US 2011/0091657 A1 Apr. 21, 2011

(30) Foreign Application Priority Data

Jun. 12, 2008 (DE) ..... 10 2008 027 994

(51) Int. Cl.

| | |
|---|---|
| ***B05D 1/02*** | (2006.01) |
| ***B05C 5/02*** | (2006.01) |
| ***B05B 15/06*** | (2006.01) |
| *B05B 13/04* | (2006.01) |
| *B05B 15/02* | (2006.01) |

(52) U.S. Cl.

CPC ..... *B05C 5/0216* (2013.01); *B05B 15/065* (2013.01); *B05B 13/0431* (2013.01); *B05B 13/0452* (2013.01); *B05B 15/025* (2013.01)

(58) Field of Classification Search
None
See application file for complete search history.

(56) References Cited

U.S. PATENT DOCUMENTS 1,038,180 A * 9/1912 Moreland ..... B05C 17/00516 401/179
2,968,441 A 1/1961 Holcomb (Continued)

FOREIGN PATENT DOCUMENTS

CA WO 2006/094409 * 9/2006 ..... G01B 11/25
DE 1993716 U 9/1968

(Continued)

OTHER PUBLICATIONS

Liu et al, "A shape memory polymer with improved shape recovery," Mater. Res. Soc. Symp. Proc. vol. 855E, W4.7.1.-W4.7.6 (2005).*

(Continued)

*Primary Examiner* — Charles Capozzi
(74) *Attorney, Agent, or Firm* — Bejin Bieneman PLC

(57) ABSTRACT

The exemplary illustrations relate to an applicator for applying a coating to a component, for example for applying a sealing compound to an edge-raised seam on a rear side of a motor vehicle body component through a gap between two overlapping motor vehicle body components, with a nozzle for dispensing the coating means onto the rear side of the component and with an elongated curved nozzle carrier in order to position the nozzle on the rear side of the component to be coated, starting from the front side of the component to be coated. It is proposed that the nozzle carrier be curved a plurality of times such that the applicator can be guided through the gap.

25 Claims, 5 Drawing Sheets

(56) References Cited

U.S. PATENT DOCUMENTS

| | | | | | |
|---|---|---|---|---|---|
| 3,402,741 | A | | 9/1968 | Yurdin | |
| 3,554,659 | A | * | 1/1971 | Stokes | 401/197 |
| 3,847,112 | A | * | 11/1974 | Wise | 118/705 |
| 4,368,686 | A | | 1/1983 | Dickson et al. | |
| 4,404,054 | A | * | 9/1983 | Dickson et al. | 156/92 |
| 4,467,533 | A | * | 8/1984 | Sica | 34/58 |
| 4,952,267 | A | * | 8/1990 | McPherson et al. | 156/291 |
| 5,029,738 | A | | 7/1991 | Dillon | |
| 5,156,593 | A | | 10/1992 | Green | |
| 5,336,349 | A | * | 8/1994 | Cornils et al. | 156/107 |
| 5,725,322 | A | * | 3/1998 | Evans | B05B 7/2443 239/532 |
| 6,547,165 | B2 | | 4/2003 | Goodwin et al. | |
| 2003/0021623 | A1 | * | 1/2003 | Harper | 401/219 |
| 2005/0056213 | A1 | | 3/2005 | Iimori et al. | |
| 2008/0022450 | A1 | | 1/2008 | Tsai | |
| 2010/0075058 | A1 | | 3/2010 | Rademacher et al. | |

FOREIGN PATENT DOCUMENTS

| | | | |
|---|---|---|---|
| DE | 19945537 | C1 | 8/2000 |
| DE | 102004039684 | A1 | 5/2005 |
| DE | 102007037865 | B3 | 9/2008 |
| DE | 102007036585 | A1 | 4/2009 |
| EP | 1 665 929 | | 6/2006 |
| JP | 07232110 | A | 9/1995 |
| JP | 07275766 | A | 10/1995 |
| JP | 2001149841 | A | 11/2002 |
| KR | 20010056720 | A | 7/2001 |
| KR | 20010079645 | | 8/2001 |
| RU | 59 450 | U1 | 12/2006 |
| WO | WO 86/00554 | | 1/1986 |
| WO | WO 93/17182 | | 9/1993 |
| WO | WO 00/09438 | | 2/2000 |
| WO | WO-00/09438 | A1 | 2/2000 |
| WO | WO 2006/094409 | A1 | 9/2006 |
| WO | WO-2009149854 | A1 | 12/2009 |

OTHER PUBLICATIONS

Hartl et al, "Aerospace applications of shape memory alloys," Proc. Inst. Mech. Eng., Pt. G: J. Aero. Eng., vol. 221(4), 535-552 (2007).*
Conference Papers of the European Automotive Coating, 15th DFO Automotive Conference, Apr. 22-23, 2008, Frankfurt.
Presentation by Mercedes Benz for the agenda entitled Automated Seam Reinforcement for Doors and Hatch Doors in built-in Condition to take place on Apr. 22, 2008.
Presentation by the Deutsche Forshungsgesellschaft fur Oberlachenbehandlung e. V., for the European Automotive Coating, 15th DFO Automotive Conference, to be held Apr. 22-23, 2008, Frankfurt a.M.
Itinerary for the European Automotive Coating, 16th DFO Automotive Conference, May 12-13, 2009, Dusseldorf presented by the Deutsche Forschungsgesellschaft fur Oberflachenbehandlung e. V.
List of participating companies attending the European Automotive Coating, 14th DFO Automotive Conference, May 8-9, 2007, Bad Kissingen, Germany.
Slide presentation by EFTEC on the topic Automated sealing nozzle in the lacquering business—a true challenge for cost reduction by Bruno Stegmaier / Axel Hunziker, EFTEC Engineering, Markdorf.
Illustration catalog by EFTEC entitled Sealing Nozzle Example Catalogue, Feb. 2, 2004.
Screenshot of an email from Bruno Stegmaier, dated Nov. 14, 2006.
An email sent by Claudia Schimkar (PAe Reinhard Skuhra Weise_ Partner GbR).
An email sent from Pedro Hurtado to Grit Heidecke, dated Mar. 31, 2008.
Participants list of Custormer Days Apr. 23, 2008-Apr. 28, 2008.
Photos of The Plant During "Customer Days".
Slide presentation for SCA Customer Open Days.
This is a presentation by Mercedes Benz for the agenda entitled Automated seam reinforcement for doors and hatch doors in built-in condidtion to take place on Apr. 22, 2008.
This is an attachment text entitled Shape Memory Alloy (SMA).
International Search Report PCT/EP2009/003974 dated Aug. 13, 2009.
Film shown at customer open days SCA Schucker Gmbh & Co., "Station2.mpg" auf Datentrager (on disk).
Russian Decision to Grant (14 pps.), 2012.
English translation of Office Action issued by the Korean Patent Office for Application No. 10-2011-7000114; dated May 14, 2015; (11 pages).
Hartl et al., "Aerospace applications of shape memory alloys," Proceedings of the Institution of Mechanical Engineers, Part G: Journal of Aerospace Engineering, SAGE Journals, Apr. 2007.
Liu et al., "A Shape Memory Polymer with Improved Shape Recovery", Mater. Res. Soc. Symp. Proc. vol. 855E (2005 Materials Research Society), W4.7.1.

* cited by examiner

APPLICATOR FOR APPLYING A SEALING COMPOUND TO AN EDGE-RAISED SEAM AND ASSOCIATED OPERATING METHOD

CROSS-REFERENCE TO RELATED APPLICATIONS

This application is a National Stage application which claims the benefit of International Application No. PCT/EP2009/003974 filed Jun. 3, 2009, which claims priority based on German Application No. 10 2008 027 994.3, filed Jun. 12, 2008, both of which are hereby incorporated by reference in their entirety.

BACKGROUND

The present disclosure concerns an applicator for applying a coating agent to a component, particularly for applying a sealant to a flanged seam on a rear side of a motor vehicle body component, the applicator particularly being able to project through a gap between two overlapping motor vehicle body components.

Motor vehicle body components (e.g. doors or bonnets) often have so-called flanged seams, in the case of which a sheet part is flanged around an edge of another sheet part, it then being possible to adhesively bond the two sheet parts to one another. Here, there is the danger that moisture penetrates into the gap between the two sheet parts and leads to corrosion there. It is therefore known to apply a sealant to the flanged seam between the two sheet parts in order to seal the flanged seam and, as a result, to reliably prevent the penetration of moisture and corrosion connected therewith.

When motor vehicle body doors are being coated, the sealant is typically applied to the flanged seam manually in practice by workers, who first open the relevant door and then apply the sealant to the flanged seam manually. As long as the sheets do not overlap, a manual application with the door closed is also possible.

However, the high outlay in terms of personnel and the associated costs are a disadvantage of this manual application of the sealant to the flanged seam.

Moreover, trial applications of the sealant to the flanged seam automatically by a coating robot have been carried out in the prior art. However, such trials for the automation of the application of the sealant have hitherto entailed considerable problems in practice, for various reasons.

On the one hand, the sealant could only be applied to the flanged seam in the case of doors and bonnets of motor vehicle bodies if the doors and bonnets are first opened, which entails additional outlay.

On the other hand, the application of the sealant to the flanged seam requires extremely high positional accuracy of the coating robot used, which is only possible with sensor-assisted positional control with readjustment of the position of the robot in accordance with the positional deviations detected. In automatic application of the sealant to the flanged seam, the outlay for equipment to achieve the necessary positional accuracy endangers the cost-effectiveness achievable by saving in terms of personnel.

An applicator is further known from the subsequently published German patent application DE 10 2007 037 865 B3 and corresponding U.S. Pat. Pub. No. US 2010/0075058, which generally disclose an automatic, robot-assisted application of sealant to a flanged seam. To this end, the known applicator has a flexible joint, as a result of which the requirements on the positional accuracy of the robot used are reduced.

Problematic in the case of the sealing of flanged seams in the region of motor vehicle doors is the fact that, on account of the crash-friendly construction of the motor vehicle doors, the motor vehicle doors move behind the respective wing in the closed state. This has the consequence that the applicator in accordance with the patent according to DE 10 2007 037 865 B3 and corresponding U.S. Pat. Pub. No. US 2010/0075058 cannot be pushed through the gap between the motor vehicle door and the wing, as these components overlap one another. In the case of the sealing of flanged seams in the region of motor vehicle doors, the motor vehicle doors must therefore hitherto be opened in order to make the flanged seams accessible for the application of the sealant.

The opening of the motor vehicle doors for the application of the sealant onto the respective flanged seam requires cycle time however, which gets lost for the actual application of the sealant. Under certain circumstances, this can lead to a plurality of operating cycles being required for the application of the sealant to the various flanged seams of the motor vehicle body.

Furthermore, the opening of the motor vehicle doors for the application of the sealant to the flanged seams generally requires an additional handling robot, which is associated with increased investment costs and a larger space requirement in the painting station.

Further, reference is also to be made to U.S. Pat. No. 2,968,441 as prior art.

Accordingly, there is a need for an applicator which makes it possible, without opening a motor vehicle door, to seal a flanged seam located on the rear side of the motor vehicle door with sealant.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1:
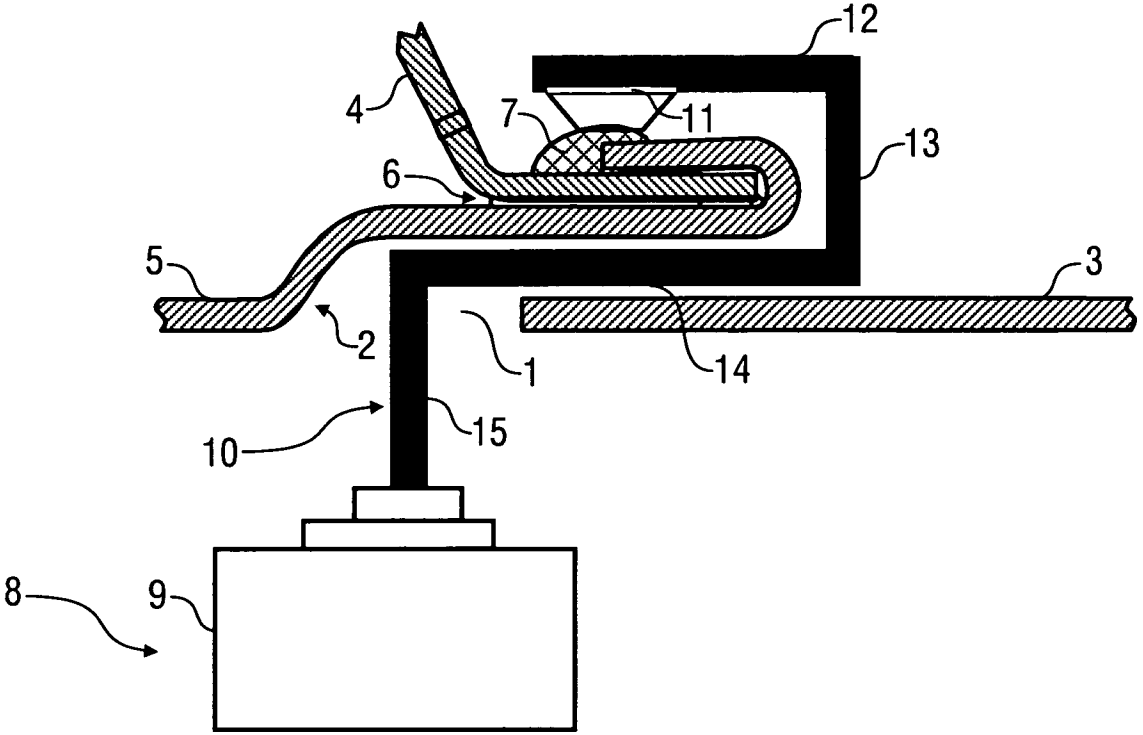
FIG. 1 shows a gap region with two overlapping motor vehicle body components and an exemplary applicator, which projects through the gap in order to apply sealant to a flanged seam on the rear side.

Generally, the exemplary illustrations are based on the object of creating an applicator which can project through a gap between overlapping components, in order to apply a coating agent (e.g. sealant) on the rear side of the components.

Furthermore, the exemplary illustrations are based on the object of specifying an operating method for an applicator of this type.

This object is achieved by an exemplary applicator and an associated operating method, as further described below.

The exemplary illustrations generally comprise the general technical teaching of constructing the applicator in such a manner that the applicator can also project through a gap between overlapping components from the front side to the rear side of the components, in order to apply coating agent on the rear side of the components. For example, the applicator can here be introduced into the gap region in the longitudinal direction of the flanged seam, which is possible for example at the front end of a gap region.

The exemplary illustrations therefore provide a nozzle carrier (e.g. a tube), which is curved a plurality of times and as a result enables the positioning of the nozzle guided by the nozzle carrier through the gap between the overlapping components on the rear side of the components, in order to apply coating agent there.

In one illustration, the nozzle carrier is essentially double-L-shaped, that is to say the nozzle carrier consists essentially of two mutually adjacent, in each case L-shaped, sections. It is alternatively also possible, however, that the nozzle carrier is essentially S-shaped. Decisive is merely the fact that the nozzle carrier is shaped in such a manner that the nozzle carrier can position the nozzle through the gap between the adjacent overlapping components on the rear side of the components in the manner required for the coating process.

In another exemplary illustration, the nozzle carrier has an essentially U-shaped section at its distal end with a distal leg, a proximal leg and a connecting leg, the connecting leg connecting the proximal leg to the distal leg. In operation, the U-shaped section of the nozzle carrier then encompasses a side edge of the component to be coated through a gap, so that the distal leg with the nozzle is located behind the component to be coated and the proximal leg is located in front of the component to be coated, whilst the connecting leg of the U-shaped section projects through the gap. Here, the nozzle is arranged at the distal leg of the U-shaped section or integrated directly into this and discharges the coating agent from the rear forwards onto the rear side of the component to be coated. The proximal leg and/or the distal leg of the U-shaped section of the nozzle carrier may, for example, have a leg length of more than 2 cm, 4 cm, 6 cm or more than 10 cm, the advantageous leg length depending on the component geometry.

In the above example with a U-shaped section at the distal end of the nozzle carrier, the nozzle carrier may have three curvatures, namely—starting from the nozzle—initially two curvatures with the same direction of curvature and then a curvature with an opposite direction of curvature. The exemplary illustrations are not limited to a certain number of curvatures with respect to the nozzle carrier, however. Rather, the exemplary illustrations also include applicators with a nozzle carrier with two or more than three curvatures. Accordingly, the nozzle carrier may be shaped in any manner that allows it to project through a gap between two adjacent laterally overlapping components onto the rear side of the components.

Between the individual curvatures, the nozzle carrier may have essentially straight sections, however, in the context of the exemplary illustrations, depending on the component geometry in the region of the space, a continuously curved nozzle carrier can also be used.

Furthermore, the individual curvatures of the nozzle carrier may be essentially right-angled. It is, however, alternatively also possible that the individual curvatures of the nozzle carrier in each case have an angle of curvature of at least 70° or at least 80°. Furthermore, it is possible that the individual curvatures of the nozzle carrier in each case have an angle of curvature of at most 110° or at most 100°.

Furthermore, it is to be mentioned that the nozzle carrier may generally run in a single plane. It is theoretically also possible however, depending on the component geometry in the region of the gap, that the individual legs of the nozzle carrier do not run in a plane.

In one exemplary illustration, the nozzle carrier has four legs which are angled at right angles to one another in each case and form a generally double-L shape. The distal leg of the nozzle carrier here runs essentially parallel to the component rear side and applies the coating agent (e.g. sealant) essentially at right angles to the component rear side. Two further legs adjoin this distal leg, which project through the gap and are angled at right angles to one another. Finally, a proximal leg is provided, which is positioned, for example, by a coating robot.

It has previously already been mentioned that the nozzle carrier may be a hollow inlet pipe through which the coating agent is conveyed to the nozzle. The exemplary illustrations also include an alternative example, in the case of which, the nozzle carrier merely has a mechanical function and is not used for conveying the coating agent, the coating agent then being able to flow for example through a hose line embedded into the nozzle carrier to the nozzle.

Furthermore, it is to be mentioned that the nozzle carrier may include a material which is elastic and/or has a shape memory. This offers the advantage that the nozzle carrier assumes it original and constructively predetermined shape again following a collision with the components to be coated, which is necessary for a highly precise positioning of the nozzle. For example, the material with a shape memory can be a nickel-titanium alloy, such as TitanFlex®, merely as one example.

Further, there is the option in the context of the exemplary illustrations that the applicator has at least one additional nozzle, such as for example a flat stream nozzle, a round jet nozzle, an airless nozzle or a further nozzle for flanged seam sealing. This enables a combination operation, in which alternately with the same applicator, flanged seams are sealed and other coatings are undertaken or another coating agent is applied.

Furthermore, the exemplary illustrations comprise not only the previously described exemplary applicator as a single component, but also a coating installation for flanged seam sealing on motor vehicle body components with such an applicator.

In the case of a coating installation of this type, a measuring device may be provided, which measures the geometry of the applicator and in particular of the nozzle carrier, in order to check whether the nozzle carrier still has the predetermined shape or has in the meantime been deformed due to a collision with the components to be coated. A measuring device of this type can for example have a light barrier which detects the outer contour of the applicator and particularly of the nozzle carrier.

Further, the coating installation according to the exemplary illustrations may includes a cleaning device, in order to blow off the applicator or the nozzle and to clean them of possibly adhering coating material and/or to rinse them with a rinsing agent, whereby cleaning devices of this type are known from the prior art and therefore do not have to be described in more detail.

Here, it is advantageous if the measuring device for measuring the geometry of the applicator is structurally integrated into the cleaning device. On the one hand, construction space is saved. On the other hand, the geometry of the applicator can be measured in this manner during the cleaning, as a result of which cycle time is saved.

Further, the exemplary applicators also can have a joint between the nozzle carrier and the connection flange used for fixing on the robot, which joint enables an avoiding movement of the nozzle carrier relatively to the connection flange. This offers the advantage that a collision between the applicator and the components to be coated does not lead immediately to damaging of the applicator, as the nozzle carrier can yield due to the joint. A joint of this type is described in the already mentioned German patent publication DE 10 2007 037 865 B3 and corresponding U.S. Pat. Pub. No. US 2010/0075058, each of which being hereby expressly incorporated by reference in their entireties.

Finally, the exemplary illustrations also comprise an operating method for an applicator, the operating method standing including projecting an applicator through a gap between two adjacent, mutually overlapping components from the front side to the rear side of the adjacent components, in order to apply coating agent on the rear side of the components.

Here, the applicator may be moved along the gap, in order to apply an elongated path of the sealant to the flanged seam.

It may be advantageous to allow the introduction of the applicator through the gap and the application of the coating agent while the motor vehicle door is closed.

Other advantageous further developments of the exemplary illustrations are explained in more detail below, with reference to the figures.

Turning now to FIG. 1, a region of a gap 1 between a motor vehicle door 2 and a wing 3 (fender) is illustrated, with the motor vehicle door 2 overlapping with the wing 3 in the closed state shown in the drawing, e.g., in order to improve crash safety.

The motor vehicle door 2 may have an inner panel 4 and a sheet metal panel 5, the sheet metal panel 5 being flanged around an angled edge of the inner panel 4. In the region of the angled edge, the inner panel 4 is connected to the sheet metal panel 5 by means of an adhesive layer 6. In this construction, there is the danger that, in the region of the flanged seam, moisture enters into the gap between the angled edge of the inner panel 4 and the flanged edge of the sheet metal panel 5 and causes corrosion. The flanged seam between the inner panel 4 and the sheet metal panel 5 is therefore sealed with a sealant 7, in order to prevent the penetration of moisture into the flanged seam, the sealant 7 extending at right angles to the drawing plane over the entire length of the flanged seam. The application of the sealant 7 here takes place by means of an exemplary applicator 8, which projects through the gap 1 between the motor vehicle door 2 and the wing 3, as is also explained in detail.

The exemplary applicator may be positioned by a multiple-axis robot and may have a connection flange 9 for mounting on the robot, the robot not being illustrated for simplification.

A tubular nozzle carrier 10 may be mounted on the connection flange 9 of the applicator 8. On the one hand, the nozzle carrier 10 is used for the mechanical guiding of a nozzle 11 which is arranged on the distal end of the nozzle carrier 10. On the other hand, the nozzle carrier 10 is used for passing through the sealant from the connection flange 9 to the nozzle 11, to which end the nozzle carrier 10 is realised in a hollow manner.

The nozzle carrier 10 has four legs 12, 13, 14, 15, which are arranged at right angles to one another in each case, the distal legs 12, 13, 14 of the nozzle carrier 10 forming a U-shaped section which encompasses the angled edge of the inner panel 5 with the flanged seam. The geometry of the applicator 8 shown enables the nozzle 11 to project through the gap 1 between the motor vehicle door 2 and the wing 3 onto the rear side of the motor vehicle door 2 and of the wing 3, in order to apply the sealant 7 to the flanged seam located there. Here, it is not necessary that the motor vehicle door 2 is opened in advance, so that a handling robot for opening the motor vehicle door 2 can be dispensed with.

Figure 2:
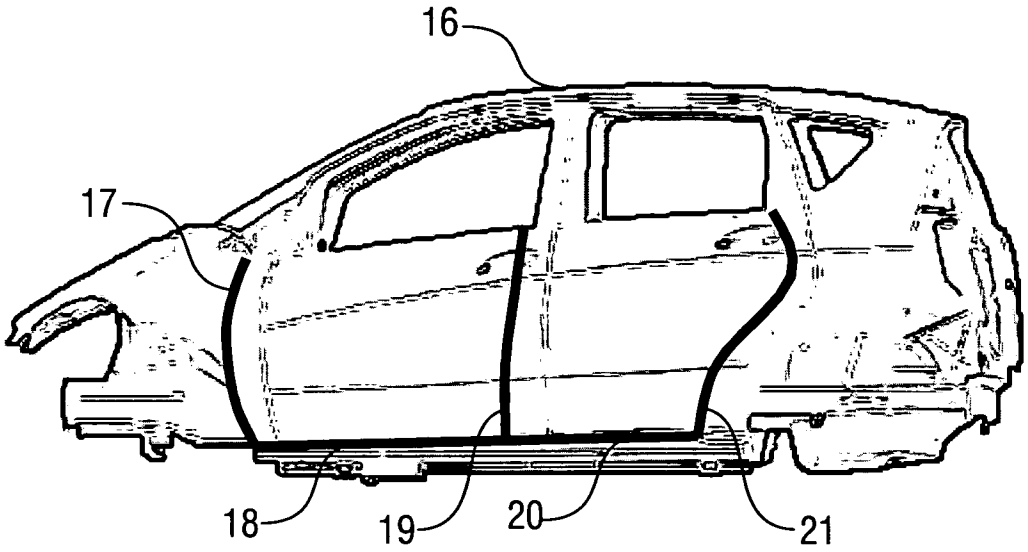
FIG. 2 shows a side view of a motor vehicle body with the gaps in which the adjacent motor vehicle body components overlap, which makes the use of the exemplary applicator.

FIG. 2 shows a side view of a motor vehicle body 16 with a plurality of flanged seams 17, 18, 19, 20, 21 which can be sealed with the sealant 7 using the applicator 8 shown in FIG. 1.

Figure 3:
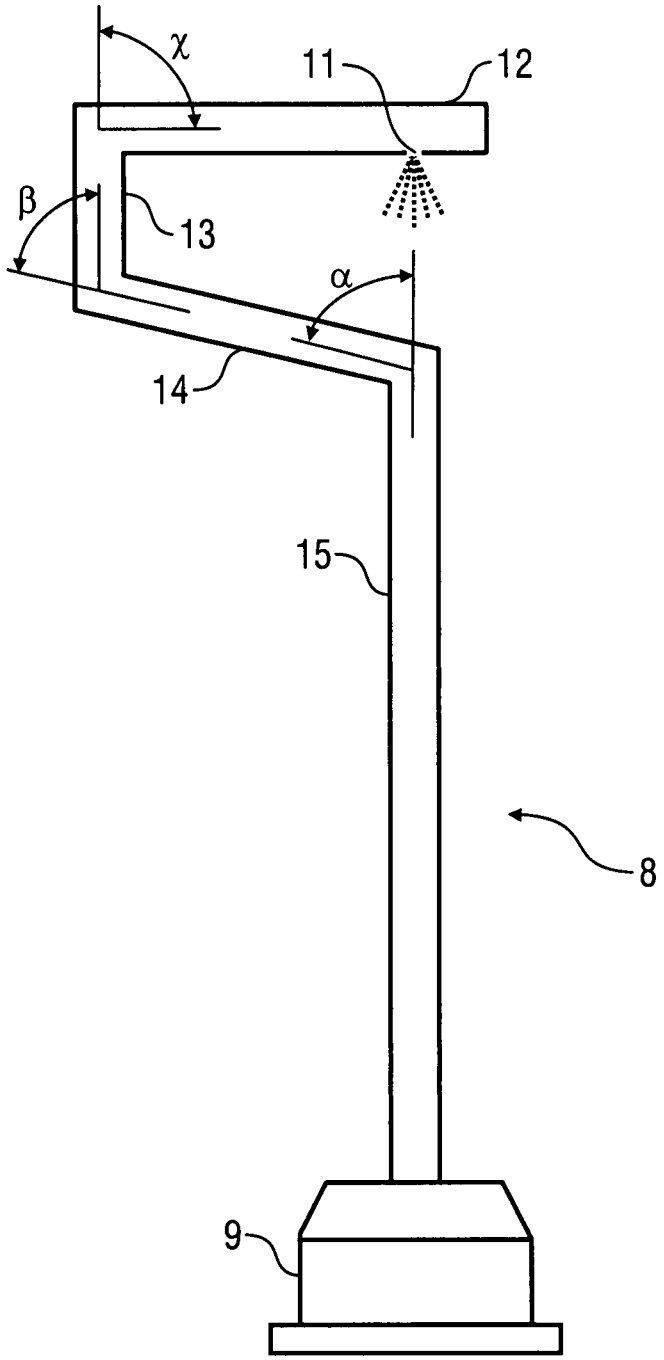
FIG. 3 shows a side view of an exemplary applicator.

FIG. 3 shows another exemplary illustration of the applicator 8, which differs slightly from the exemplary embodiment according to FIG. 1.

So, the leg 14 of the nozzle carrier 10 has an angle of curvature $\alpha \approx 80°$ with respect to the leg 15 of the nozzle carrier 10.

By contrast, the leg 13 has an angle of curvature $\beta \approx 80°$ with respect to the leg 14 of the nozzle carrier 10.

Finally, the leg 12 of the nozzle carrier 10 has an angle of curvature $\chi = 90°$ with respect to the leg 13, as is also the case in the exemplary embodiment according to FIG. 1.

Figure 4:
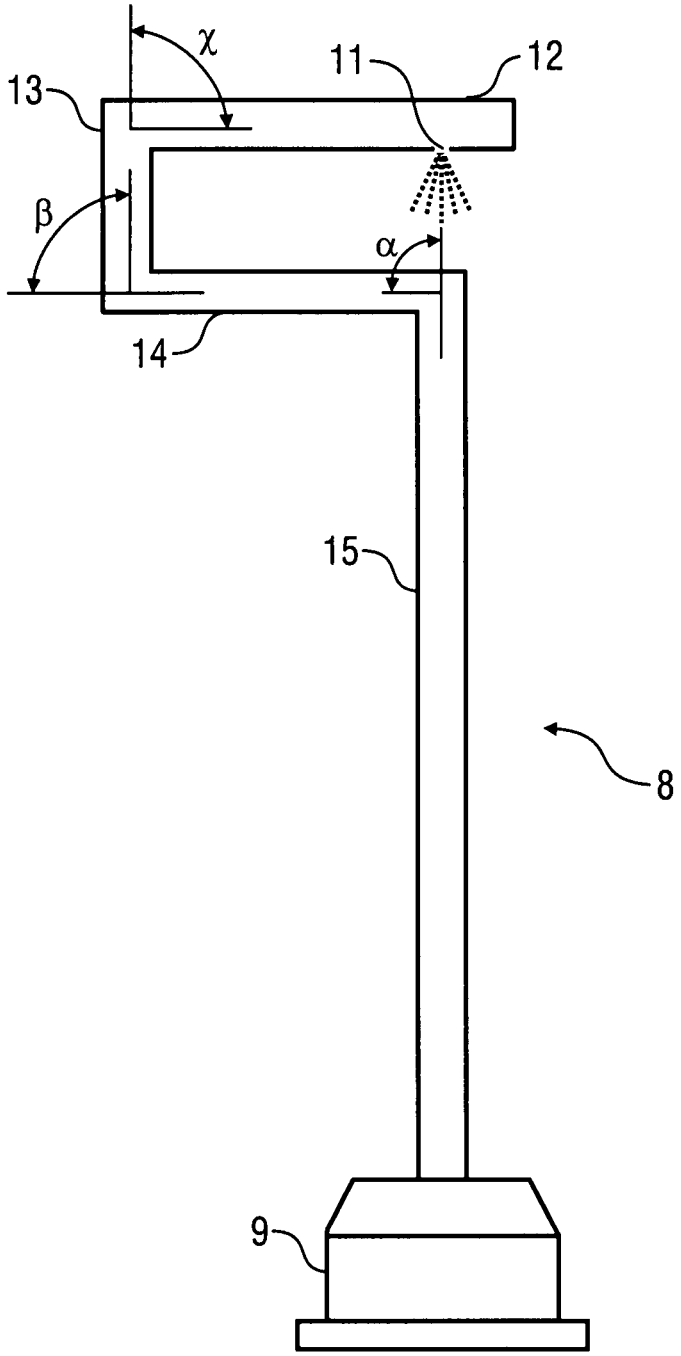
FIG. 4 shows a side view of a further exemplary applicator as well as a measuring device for measuring the geometry of the exemplary applicator.

FIG. 4 shows a modified exemplary embodiment which substantially tallies with the exemplary illustration according to FIG. 1, the angle of curvature $\alpha = \beta = \chi = 90°$.

Figure 5:
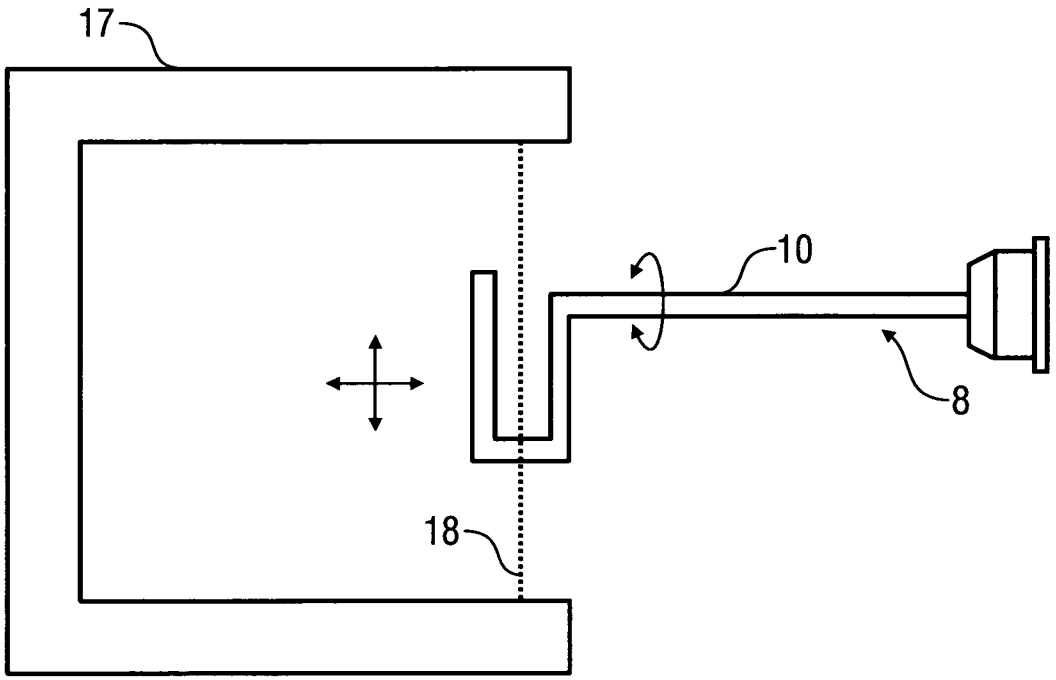
FIG. 5 shows a measuring device for measuring the geometry of an exemplary applicator.

Finally, FIG. 5 shows a measuring device 17 for measuring the geometry of the applicator 8. To this end, the measuring device 17 has a light barrier 18 which scans the outer contour of the applicator 8 and particularly of the nozzle carrier 10. The measuring of the geometry of the applicator 8 may advantageously enable the recognition of deformations of the applicator 8, which for example can originate from collisions between the applicator 8 and the motor vehicle door 2 or the wing 3.

Here, the measuring device 17 may advantageously be integrated into a cleaning device which is used to clean the applicator 8 by means of blowing off or by means of rinsing with a rinsing agent. The integration of the measuring device 17 into the cleaning device offers the advantage that construction space and cycle time are saved, as the measuring of the applicator 8 can take place during the cleaning of the applicator 8 which is required anyway.

The exemplary illustrations are not limited to the specific examples illustrated above. Rather, a plurality of variations and alterations are possible that also make use of the ideas described herein, and therefore fall within the scope of protection. Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

LIST OF REFERENCE NUMERALS

1 Gap
2 Motor vehicle door
3 Wing
4 Inner panel
5 Sheet metal panel
6 Adhesive layer
7 Sealant
8 Applicator
9 Connection flange
10 Nozzle carrier
11 Nozzle
12-15 Leg
16 Motor vehicle body
17 Measuring device
18 Light barrier

The invention claimed is:

1. An applicator for applying a sealant to a flanged seam on a rear side of a motor vehicle body component, said applicator comprising:

a nozzle opening, an elongated nozzle carrier extending from a front side of the component and positioning the nozzle opening on the rear side of the component to be coated, wherein the elongated nozzle carrier has a distal first leg that carries the nozzle opening, a second leg that adjoins the first leg and extends at a first angle relative to the first leg, a third leg that adjoins the second leg and extends at a second angle relative to the second leg, and a fourth leg that adjoins the third leg and extends longitudinally in a direction at a third angle relative to the third leg, and wherein the nozzle opening faces the rear side of the component in a direction substantially parallel with the direction of the fourth leg, and the distal first leg of the elongated nozzle carrier and the nozzle opening configured to project the sealant directly onto the rear side of the component from a non-contacting position relative to the component.

2. The applicator according to claim 1, wherein the applicator is adapted to apply the sealant through a gap between two laterally overlapping vehicle body components.

3. The applicator according to claim 1, wherein the nozzle carrier includes two mutually adjacent-L-shaped sections.

4. The applicator according to claim 1, wherein the nozzle carrier is substantially S-shaped.

5. The applicator according to claim 1, wherein the nozzle carrier is adapted to project through a gap between two adjacent, laterally overlapping motor vehicle body components from the front side to the rear side of the motor vehicle body components.

6. The applicator according to claim 1, wherein a) individual curvatures of the nozzle carrier are in each case substantially right-angled, and b) the nozzle carrier runs in a plane.

7. The applicator according to claim 1, wherein the second leg is curved with respect to the first leg with a first angle of curvature between 70° and 110°, the third leg is curved with respect to the second leg with a second angle of curvature between 70° and 110°, and the fourth leg is curved with respect to the third leg with a third angle of curvature between 70° and 110°.

8. The applicator according to claim 7, wherein the first leg and the third leg run substantially parallel to one another, and the second leg and the fourth leg run essentially parallel to one another.

9. The applicator according to claim 1, wherein the nozzle carrier is a hollow inlet pipe through which the sealant is conveyed to the nozzle.

10. The applicator according to claim 1, wherein the nozzle carrier consists of a material which is elastic and has a shape memory.

11. The applicator according to claim 10, wherein the material of the nozzle carrier is a nickel-titanium alloy.

12. The applicator according to claim 1, further comprising at least one additional nozzle, wherein the additional nozzle is selected from the group consisting of:

a) a flat stream nozzle, b) a round jet nozzle, c) an airless nozzle and d) a nozzle for flanged seam sealing.

13. A coating installation adapted for flanged seam sealing on motor vehicle body components with the applicator according to claim 1.

14. The coating installation according to claim 13, further comprising a measuring device which measures the geometry of the applicator.

15. The coating installation according to claim 14, wherein the measuring device includes a light barrier.

16. The coating installation according to claim 14, wherein a cleaning device is provided for blowing off or rinsing the applicator.

17. The coating installation according to claim 16, wherein the measuring device is structurally integrated into the cleaning device.

18. An operating method for an applicator for applying a sealant to a flanged seam on a rear side of a motor vehicle body component, comprising:

projecting the applicator through a gap between two adjacent components from a front side to a rear side of the adjacent components, wherein the two adjacent components overlap in the lateral direction, wherein an elongated nozzle carrier has a first distal leg that carries a nozzle opening, the nozzle carrier has a second leg that adjoins the first leg and extends at a first angle relative to the first leg, the nozzle carrier has a third leg that adjoins the second leg and extends at a second angle relative to the second leg, and the nozzle carrier has a fourth leg that adjoins the third leg and extends longitudinally in a direction at a third angle relative to the third leg, positioning the nozzle opening to face the rear side of one of the components, coating the one of the two adjacent components with the applicator on the rear side with the sealant wherein the nozzle opening faces the rear side of the component in a direction substantially parallel with the direction of the fourth leg, the distal first leg of the elongated nozzle carrier and the nozzle opening configured to project the sealant directly onto the rear side of the component from a non-contacting position relative to the component.

19. The operating method according to claim 18, wherein the applicator is moved along the gap.

20. The operating method according to claim 18, wherein a) one of the two components is a motor vehicle door, and b) the applicator projects through the gap and the sealant is applied, whilst the motor vehicle door is closed.

21. The operating method according to claim 18, wherein the applicator is moved by a multiple-axis robot.

22. The operating method according to claim 18, wherein the geometry of the applicator is measured.

23. The operating method according to claim 22, wherein the geometry of the applicator is measured by means of a light barrier.

24. The operating method according to claim 18, further comprising:

cleaning the applicator, including blowing off with air or a cleaning fluid and/or by rinsing with a rinsing agent, wherein the geometry of the applicator is measured during the cleaning.

25. The applicator according to claim 1 wherein the first leg, the second leg, the third leg, and the fourth leg are substantially straight.

* * * * *